United States Patent [19]

Laky et al.

[11] 4,087,060

[45] May 2, 1978

[54] SELF LEVEL WIND CABLE STORAGE REEL

[75] Inventors: Elmer Laky, Cranford; Ralph Walsh, Oceanport, both of N.J.

[73] Assignee: Breeze Corporations, Inc., Union, N.J.

[21] Appl. No.: 731,851

[22] Filed: Oct. 12, 1976

[51] Int. Cl.[2] ..... B65H 57/28

[52] U.S. Cl. ..... 242/158 R; 242/117; 254/175.7

[58] Field of Search ..... 254/190 R, 175.7, 174, 254/186 R, 168, 150 R; 242/7.03, 7.13, 158 R, 117

[56] References Cited

U.S. PATENT DOCUMENTS

| | | | |
|---|---|---|---|
| 2,776,096 | 1/1957 | Isbell | 254/175.7 |
| 3,020,022 | 2/1962 | Tranquist | 254/175.7 |
| 3,237,875 | 3/1966 | Van der Hoet et al. | 242/7.13 |
| 3,339,753 | 9/1967 | Porster et al. | 254/186 R |
| 3,804,370 | 4/1974 | Woodard | 254/186 R |
| 3,843,094 | 10/1974 | Watts | 254/150 R |
| 3,851,830 | 12/1974 | Barthalon | 242/7.03 |

*Primary Examiner*—Trygve M. Blix
*Assistant Examiner*—Kenneth Noland
*Attorney, Agent, or Firm*—Albert F. Kronman

[57] ABSTRACT

A cable storage reel for a hoist is provided with a drum having a plurality of spaced concentric grooves to receive the cable thereon. The reel is mounted upon an elongated bearing and is free to slide longitudinally thereon. The drum of the reel is provided with a longitudinal gap traversing the concentric grooves. The reel is also keyed to the elongated bearing. An elastomeric roller is freely carried adjacent the storage reel with the reel flanges in frictional contact with the roller. When the reel is driven by the bearing to take up the cable, the cable as it reaches the gap, crosses over to the next concentric groove causing the reel to move laterally along the elongated bearing, the flanges to follow a helical path across the roller to drive the reel laterally and to level wind the cable.

1 Claim, 5 Drawing Figures

SELF LEVEL WIND CABLE STORAGE REEL

BACKGROUND OF THE INVENTION view on

It is well-known in the hoist art to direct cable being wound upon a drum in such a manner that it is smoothly disposed thereon. To accomplish the desired positioning of the cable there have been provided a large number of level wind mechanisms. Such prior art level wind devices have consisted of relatively complicated mechanisms including level wind screws, guides, and rotary power means to assure an orderly wind of the cable on the storage drum.

The present invention eliminates the complicated, heavy, and expensive mechanisms of prior art devices and provides a level wind mechanism which is simple in construction, dependable, and capable of application to many types of reeling machines. Wear of the cable resulting from friction imparting level wind mechanisms is avoided and failure of the reeling device due to failure of the level wind mechanism is eliminated.

SUMMARY OF THE INVENTION

In a preferred embodimemt of the present invention, a cable storage reel having end flanges and a cylindrical cable receiving drum is provided with a series of concentric grooves in the drum surface of a size which will receive the cable. The reel is mounted upon an elongated bearing which is driven by a suitable source of rotary power. The reel is keyed to the bearing so that it is free to move longitudinally thereon during take up and pay out operations. An elastomeric roller freely carried adjacent the reel is in frictional contact with the reel flanges.

The surface of the drum is interrupted by a longitudinal gap which is of a depth at least as great as that of the grooves. As the reel is rotated during cable take up operations, the normal loading on the cable causes the cable to cross over the gap in such a manner as to pick up the next adjacent concentric groove. The reel is thereby forced longitudinally upon the bearing and the cable level wound. The flanges riding upon the elastomeric roller describe a helical path in the said roller, and the roller prevents lateral motion of the reel when the hoist is stopped.

DESCRIPTION OF THE DRAWINGS

In the accompanying drawings forming part hereof, corresponding parts have been given identical reference numerals, in which drawings.

GENERAL DESCRIPTION OF THE INVENTION

Figures 1, 2:
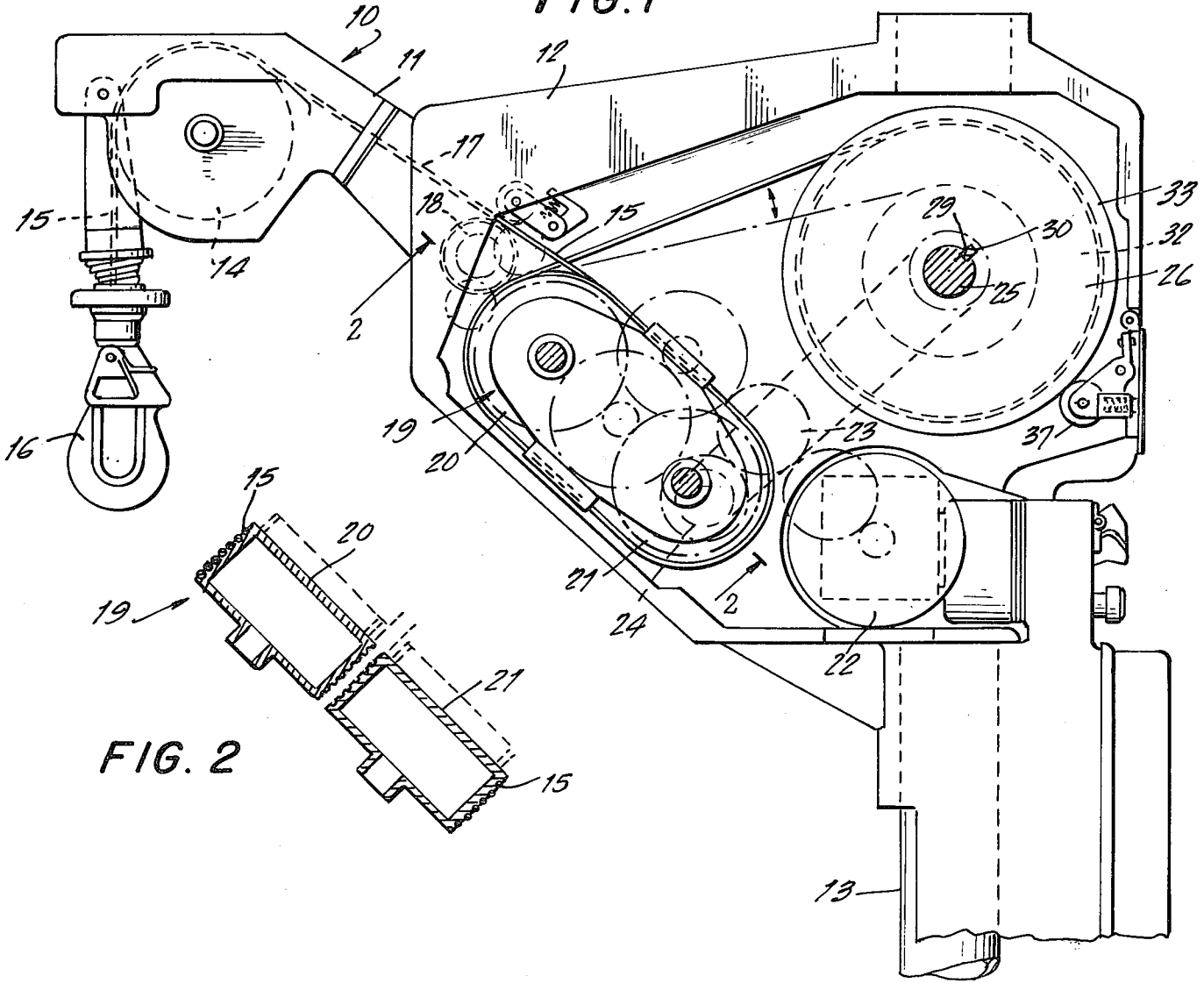
FIG. 1 is a view in side elevation, partially broken away and partially shown in phantom of a complete embodiment of the present invention.
FIG. 2 is a cross-sectional view taken on line 2—2 of FIG. 1 looking in the direction of the arrows.

Referring to the drawings and particularly FIG. 1; 10 indicates a hoist incorporating the present invention. The hoist 10 consists of a boom 11 extending from a housing 12 which is mounted upon a vertical support 13. The outer end of the boom 11 is provided with a pulley 14 over which is led the hoist cable 15. The free end of the cable 15 is secured to a cargo hook 16 in the well-known manner.

The cable 15 is led into the housing 12 of the hoist as indicated in dashed lines 17 through a powered reel structure 18 well-known in the art. The powered reel structure drives the cable 15 during its payout or reel-in operation to prevent the cable from loosening while being handled within the hoist.

The cable coming from the powered reel 18 is directed over a double capstan assembly 19 consisting of spaced drums 20, 21 upon which the cable is wound. The drums 20, 21 are driven by a motor 22 through a gear train 23. A pulley 24 shown in dashed lines in FIG. 1 is driven by the gear train 23 and is coupled to a long bearing 25 within a storage reel 26 as hereinafter more fully described. The cable 15 as it leaves the double capstan assembly 19 (see FIG. 2) is led over the storage reel 26 where it is stored or released depending upon the operation of the hoist.

Figure 3:
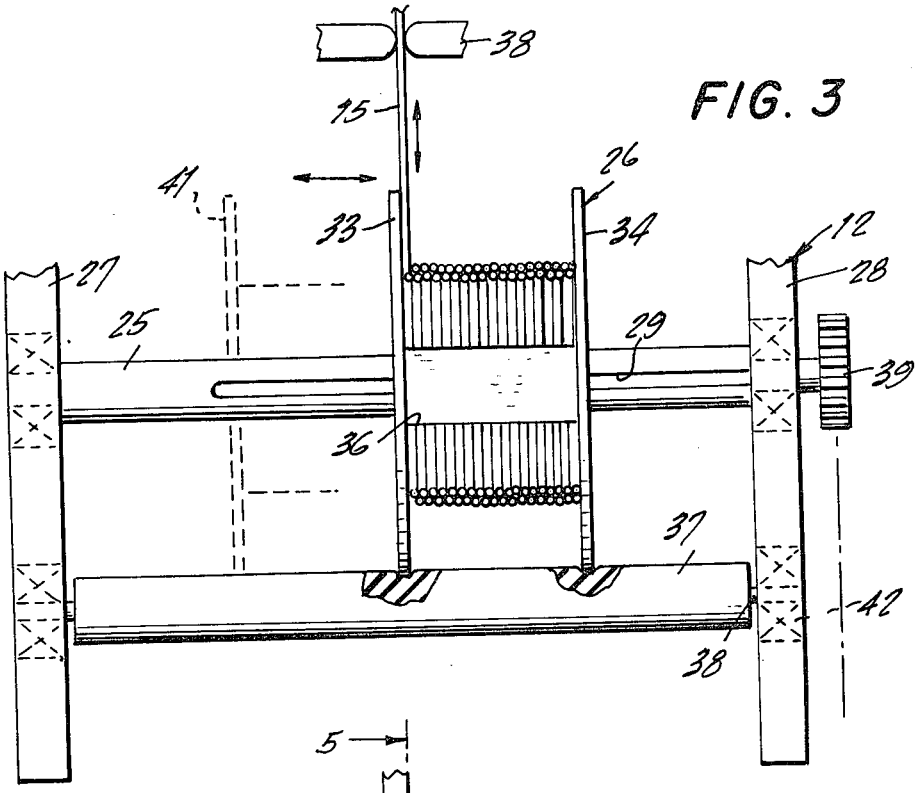
FIG. 3 is a view on an enlarged scale partly broken away showing the self level winding reel and its associated components.
Figure 4:
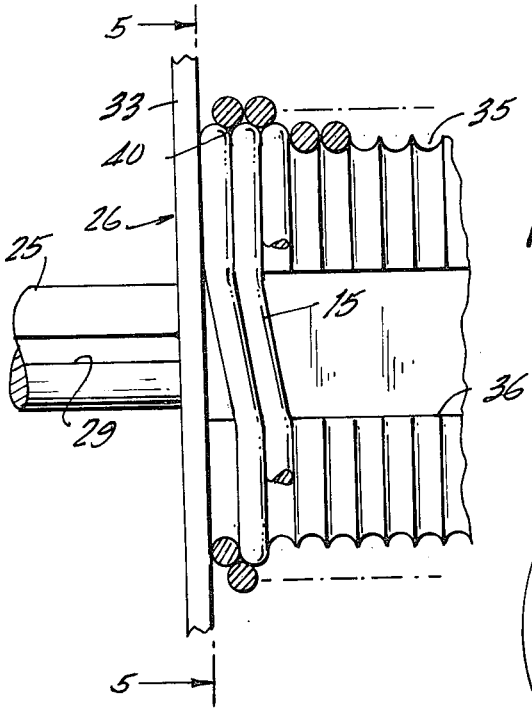
FIG. 4 is a fragmentary elevational viewon an enlarged scale of a portion of the reel shown in FIG. 3.
Figure 5:
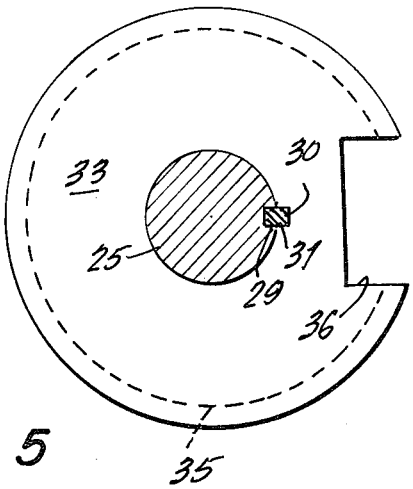
FIG. 5 is a sectional view taken on line 5—5 in FIG. 4 looking in the direction of the arrows.

Referring to FIGS. 3, 4, and 5 there is shown the construction of the self level wind portion of the hoist according to the present invention. It will be seen from an examination of FIG. 3 that the side walls 27, 28 of the housing 12 serve to freely receive the storage reel elongated bearing 25 therebetween. The elongated bearing is provided with an elongated spline 29 which slidably receives a key 30 shown in dashed lines in FIG. 1. The key 30 also engages the key way 31 of the storage reel 26. The storage reel 26 is thus free to move along the bearing 25 of the self level wind device.

The storage reel 26 consists of a drum 32 and end flanges 33, 34. As best shown in FIG. 4 and drum 32 is provided with a series of annular grooves 35 of a radius such that each groove will receive the cable 15 so as to support the cable from lateral motion without wear. Each annular groove is intersected by an elongated recess or gap 36 best shown in FIGS. 4 and 5, said gap having a depth at least that of the annular grooves 35.

The end flanges 33, 34 are in frictional contact with an elastomeric roller 37 freely journaled at each end upon short stub shafts 38 carried within bearings 42 in the housing side walls 27, 28. The flanges 33, 34 compress the elastomeric roller 37 for a short distance as shown in FIG. 3 by reason of an initial pressure imposed during the assembly of the level wind device. The elastomer may be neoprene, rubber, silicone rubber or the like.

When the cable 15 is secured to the storage reel 26 an initial number of turns of the order of three or four are hand wound upon the drum 32. The cable 15 is then led through a fixed point guide 38 as shown in FIG. 3. In winding the cable upon the drum 32 the cable will receive the configuration shown in FIG. 4 as it is led across the gap 36. Microswitches connected to clutches (not shown) stop the cable before the final few turns are paid out. In this manner, there always remain turns of cable upon the drum which act as a guide for succeeding turns of cable as the cable is reeled in upon the storage drum. Since the cable crosses over from one concentric groove to the other in the area of the gap 36, frictional contact between adjacent cable members is substantially eliminated and other frictional problems are overcome.

From the foregoing description the operation of the operation of the self level wind device will be understood to be as follows:

As the hoist motor 22 drives the gear 39 (or pulley if one is used) during cable take up operations, the cable 15 will be drawn through the fixed point guide 38 and led upon the drum 32. The drum will always present a groove 35 to receive the cable or, where the first lay cable has been completed such as is shown in FIG. 3, there will be present a recess 40 between adjacent turns of the cable to receive the cable being reeled in. As the cable 15 reaches the gapped portion of the drum, the normal loading on the cable will cause it to follow the preceeding turn and move the storage reel 26 laterally as indicated by the dashed lines 41 in FIG. 3. The flanges 33, 34 will thus be caused to walk along the elastomeric roller 37 forming, in effect, a helical path along said roller. As additional turns of cable are reeled in, the storage reel 26 will continue to move back and forth upon the elongated bearing 25 until the hook 16 reaches its extreme elevated position at which point, a microswitch (not shown) will stop the motor 22 in accordance with well-known hoist design.

When the cable 15 is paid out the above operation will be reversed and the storage reel will again move back and forth upon the bearing 25 as the cable 15 is removed from it.

It has been found that with a drum having a diameter of 5.00 inches and a length of 10.00 inches to receive cable having a diameter from 0.187 to 0.190 inches, radial grooves having a diameter of 0.190 inches and a depth of 0.019 inches constitutes a satisfactory embodiment. In addition to the above dimensions, a suitable gap 36 is of a width of 3.00 inches and a depth of 0.019 inches.

The fixed point guide 38 is disposed midway between the travel of the reel 26 along the elongated bearing to minimize wear on the cable. The guide 38 may be anti-friction blocks as shown in FIG. 3, a ring or rollers.

While the foregoing description has been directed to a self level wind device for a cable such as is used on a hoist, it will be apparent that it has application to a wide variety of structures where level winding is required and the invention is not intended to be limited to the given example.

Having thus fully described the invention, what is desired to be secured by Letters Patent is:

1. A self level wind device for a cable comprising an elongated bearing member, spaced supports at each end of the bearing member to rotatably secure the bearing member, a reel coupled to and axially movable with respect to the bearing member, a drum portion on said reel, flanges at each end of the drum portion, a plurality of spaced annular grooves said grooves having a depth no greater than the diameter of the cable in the drum to receive the cable, a longitudinal recess in the surface of the drum extending across the grooves, said recess having a depth at least equal to the bottom of the grooves in the drum, a fixed position cable guide spaced from the drum to direct the cable on to and away from the said drum, an elastomeric roller adjacent the reel, said roller being freely carried at its ends, parallel with the longitudinal axis of the drum and in frictional contact with the flanges whereby the elastomeric roller surface is compressed beneath the flanges as the reel is rotated and, said flanges axially displace to assume a helical path as a result of an axial force imposed by the cable as it moves across the recess and which results in a self-level wind effect, and a source of rotary power coupled to the elongated bearing member to drive the reel.

* * * * *